US009455535B1

(12) United States Patent
Chiang et al.

(10) Patent No.: US 9,455,535 B1
(45) Date of Patent: Sep. 27, 2016

(54) PLUG CONNECTOR

(71) Applicant: Cheng Uei Precision Industry Co., Ltd., New Taipei (TW)

(72) Inventors: Chih-Hsien Chiang, New Taipei (TW); Sheng-Nan Yu, New Taipei (TW)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/840,044

(22) Filed: Aug. 30, 2015

(51) Int. Cl.
*H01R 13/6593* (2011.01)
*H01R 13/6585* (2011.01)

(52) U.S. Cl.
CPC ..... *H01R 13/6585* (2013.01)

(58) Field of Classification Search
CPC ..... H01R 13/6585
USPC ..... 439/607.05, 92, 620.22, 660, 607.08, 439/607.1, 497, 607.04, 924.1, 924.2, 188, 439/607.02, 607.17, 607.19, 607.35, 607.36
See application file for complete search history.

(56) References Cited

U.S. PATENT DOCUMENTS 9,209,573 B1 * 12/2015 Chen ..... H01R 13/6581
9,252,542 B2 * 2/2016 Little ..... H01R 13/6585
9,362,695 B2 * 6/2016 Yu ..... H01R 24/70
2009/0156027 A1 * 6/2009 Chen ..... H01R 13/6485 439/83
2015/0244118 A1 * 8/2015 Lin ..... H01R 24/60 439/357
2015/0288107 A1 * 10/2015 Wu ..... H01R 13/6593 439/357
2016/0013595 A1 * 1/2016 Kao ..... H01R 13/6591 439/607.55
2016/0013599 A1 * 1/2016 Ueda ..... H01R 13/6596 439/607.01

* cited by examiner

*Primary Examiner* — Abdullah Riyami
*Assistant Examiner* — Nelson R Burgos-Guntin
(74) *Attorney, Agent, or Firm* — Cheng-Ju Chiang

(57) ABSTRACT

A plug connector includes an insulating housing, a terminal module, a middle shielding piece, and a shielding shell surrounding the insulating housing and the terminal module. The terminal module includes a first terminal module and a second terminal module. The middle shielding piece is mounted between the first terminal module and the second terminal module. The terminal module together with the middle shielding piece is assembled to the insulating housing. The middle shielding piece has a base plate. Two portions of two opposite sides of the base plate extend outward and then extend frontward to form two lateral arms. An upper end of a rear surface of each of the lateral arms meanders rearward to form a soldering portion projecting out of the insulating housing. A thickness of the soldering portion is thinner than thicknesses of the base plate and the lateral arms.

14 Claims, 7 Drawing Sheets

PLUG CONNECTOR

BACKGROUND OF THE INVENTION

1. Field of the Invention

The present invention generally relates to a plug connector, and more particularly to a USB 3.1 plug connector.

2. The Related Art

At present, USB 3.1 specifications are the newest USB specifications. The USB 3.1 specifications are launched by Intel company and other major companies. A data transmission speed of a USB 3.1 connector can be promoted to 10 Gbps, and a maximum power supply capability of the USB 3.1 connector is promoted to 100 W. Comparing with current USB technologies, a more efficient data coding system is applied in a USB 3.1 technology, and more than doubled throughput rates of valid data is provided. The USB 3.1 technology is completely compatible with current USB connectors and cables. Interface types of the USB 3.1 connectors are Type-A, Type-B and Type-C. In order to cater to development demand of thinner devices, new USB 3.1 Type-C interfaces need to be developed.

A current plug connector which is a USB 3.1 plug connector generally includes an insulating housing, a terminal module, a middle shielding piece and a shielding shell. The middle shielding piece is assembled to the terminal module. The terminal module together with the middle shielding piece is assembled to the insulating housing. The shielding shell encloses the insulating housing together with the terminal module and the middle shielding piece. The middle shielding piece has a base portion, and a soldering portion extended rearward from the base portion. When the plug connector is soldered on a circuit board, the soldering portion of the middle shielding piece is soldered on the circuit board.

However, the soldering portion of the middle shielding piece is hardly soldered on the circuit board on account of the soldering portion of the middle shielding piece having a worse elasticity, so the above-mentioned plug connector is hardly soldered on the circuit board. As a result, signals transmitted by the plug connector are unstable.

SUMMARY OF THE INVENTION

An object of the present invention is to provide a plug connector. The plug connector includes an insulating housing, a terminal module, a middle shielding piece and a shielding shell. The insulating housing has a base body. A front end of the base body defines an insertion chamber penetrating through a middle of a front surface of the base body. A rear end of the base body defines an assembling groove vertically penetrating through a middle of the rear end of the base body and further penetrating through a rear surface of the base body. A middle of a front wall of the assembling groove is recessed frontward to form a fastening slot extending in a transverse direction. The terminal module includes a first terminal module, and a second terminal module mounted to the first terminal module. The first terminal module has a first main body assembled in the assembling groove, and a plurality of first terminals fixed to the first main body. Rear ends of the first terminals project beyond a rear surface of the first main body, and front ends of the first terminals project beyond a front surface of the first main body. The second terminal module has a second main body assembled in the assembling groove, and a plurality of second terminals fixed to the second main body. Rear ends of the second terminals project beyond a rear surface of the second main body, and front ends of the second terminals project beyond a front surface of the second main body. The middle shielding piece is mounted between the first terminal module and the second terminal module. The terminal module together with the middle shielding piece is assembled to the assembling groove of the insulating housing. The middle shielding piece has a base plate. A front end of the base plate of the middle shielding piece is fastened to the fastening slot. Two portions of two opposite sides of the base plate extend outward and then extend frontward to form two lateral arms spaced from the two opposite sides of the base plate. An upper end of a rear surface of each of the lateral arms meanders rearward to form a soldering portion projecting out of the insulating housing. A thickness of the soldering portion is thinner than thicknesses of the base plate and the lateral arms. The shielding shell surrounds the insulating housing and the terminal module.

As described above, the thickness of the soldering portion of the middle shielding piece is thinner than the thicknesses of the base plate and the lateral arms of the middle shielding piece for improving an elasticity of the soldering portion, so the soldering portion is easily soldered on a circuit board. As a result, signals transmitted by the plug connector are stable.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
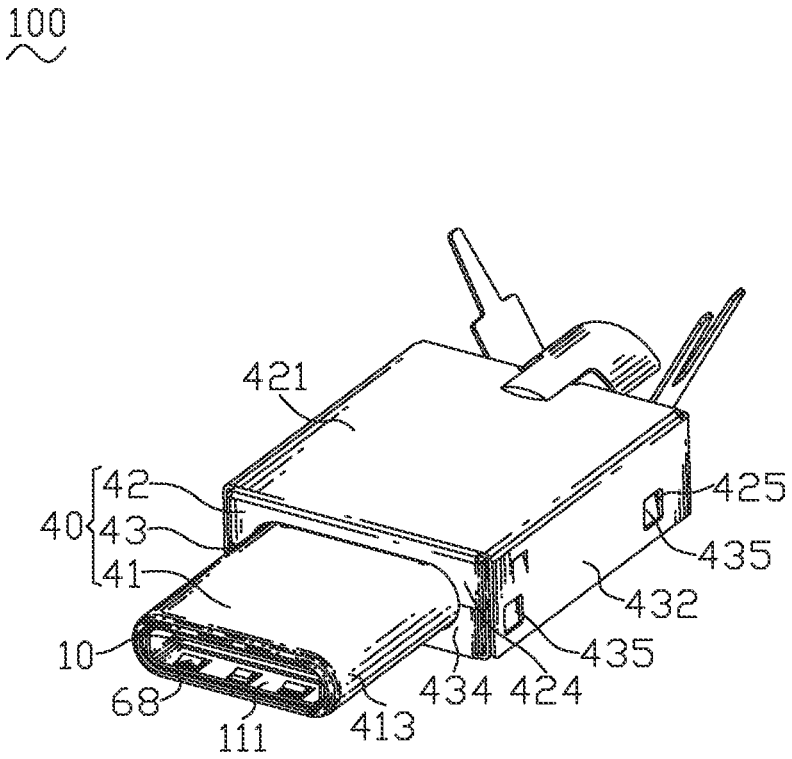
FIG. 1 is a perspective view of a plug connector in accordance with the present invention.
Figure 2:
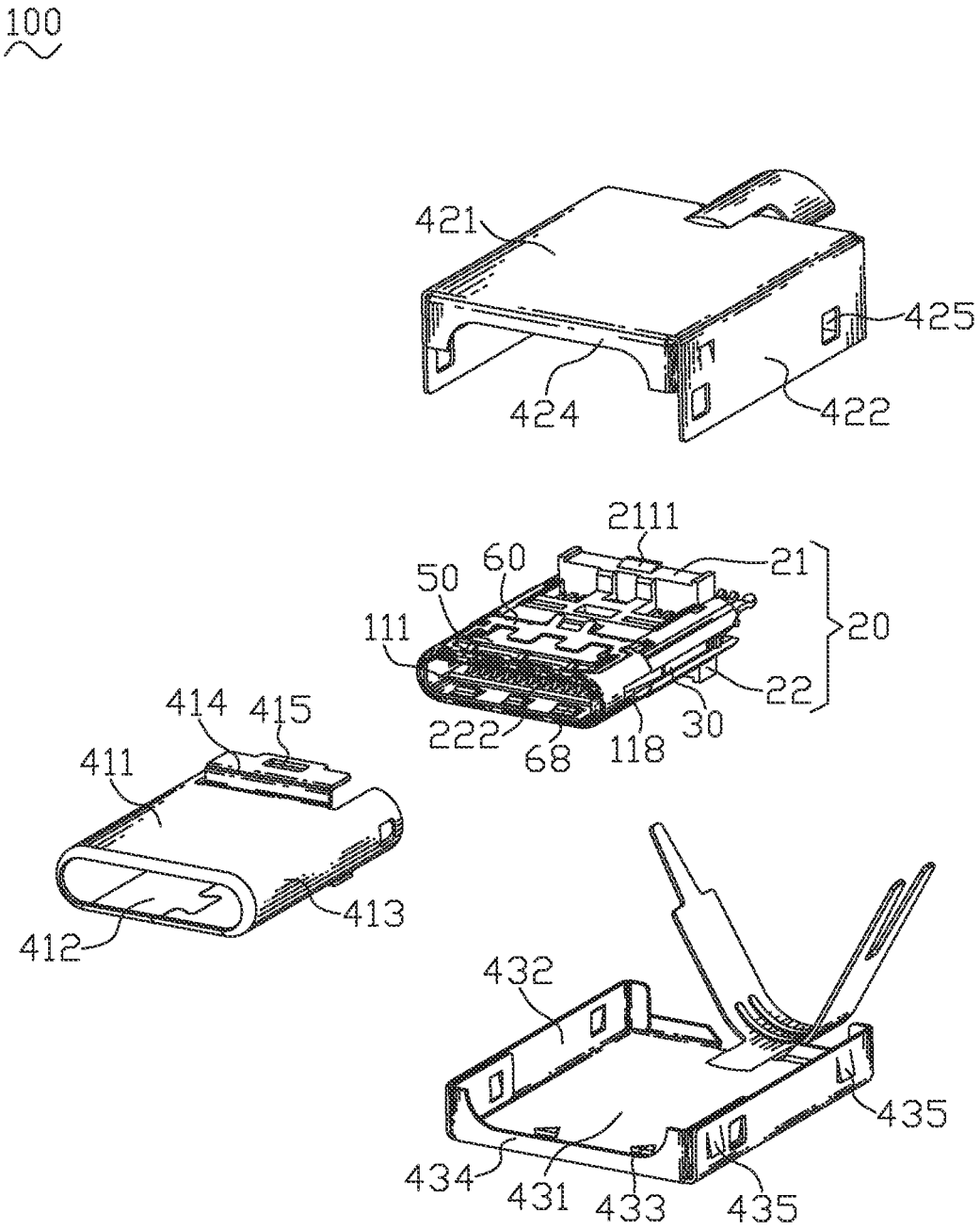
FIG. 2 is a partially exploded view of the plug connector of FIG. 1.
Figure 4:
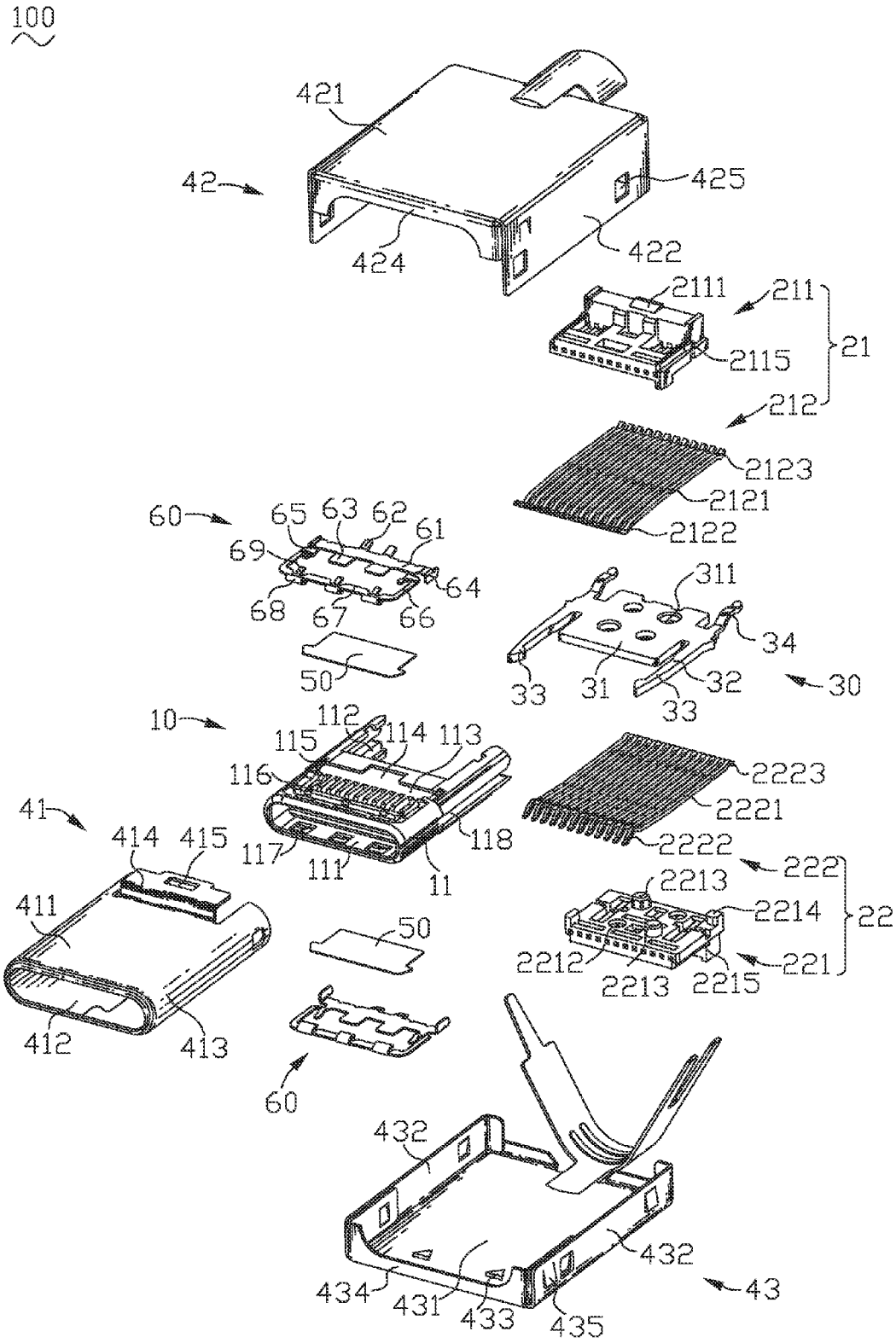
FIG. 4 is an exploded view of the plug connector of FIG. 1.

With reference to FIG. 1, FIG. 2 and FIG. 4, a plug connector 100 in accordance with the present invention is shown. The plug connector 100 includes an insulating housing 10, a terminal module 20, a middle shielding piece 30, a shielding shell 40, two insulation films 50 and two ground pieces 60. The plug connector 100 is a USB 3.1 plug connector.

Referring to FIG. 3 to FIG. 7, the insulating housing 10 has a base body 11. A front end of the base body 11 defines an insertion chamber 111 penetrating through a middle of a front surface of the base body 11. The insertion chamber 111 is matched with an insertion portion (not shown) of a receptacle connector (not shown). A rear end of the base body 11 defines an assembling groove 112 vertically penetrating through a middle of the rear end of the base body 11 and further penetrating through a rear surface of the base body 11. A middle of a front wall of the assembling groove 112 is recessed frontward to form a fastening slot 1121 extending in a transverse direction.

Referring to FIG. 3 to FIG. 7, the base body 11 defines a plurality of first terminal grooves 1122 arranged at regular intervals, and a plurality of second terminal grooves 1123 arranged at regular intervals. The second terminal grooves 1123 are located under the first terminal grooves 1122. A front end of each of the first terminal grooves 1122 penetrates through a top wall of the insertion chamber 111. A rear end of each of the first terminal grooves 1122 penetrates through an upper portion of the front wall of the assembling groove 112. A front end of each of the second terminal grooves 1123 penetrates through a bottom wall of the insertion chamber 111. A rear end of each of the second terminal grooves 1123 penetrates through a lower portion of the front wall of the assembling groove 112. Rear ends of the first terminal grooves 1122 and the second terminal grooves 1123 are communicated with the assembling groove 112. The fastening slot 1121 is located between first terminal grooves 1122 and the second terminal grooves 1123.

Referring to FIG. 3 to FIG. 7, substantially middles of a top surface and a bottom surface of the base body 11 are recessed inward to form two recesses 113. The two recesses 113 are respectively communicated with the first terminal grooves 1122 and the second terminal grooves 1123. Middles of rear walls of the two recesses 113 are recessed rearward to form two indentations 114. Rear ends of two sides of a bottom wall and two sides of a top wall of the two recesses 113 are recessed inward to form a plurality of fixing slots 115. Front ends of the bottom wall and the top wall of the two recesses 113 protrude outward to form two protruding ribs 116. The two protruding ribs 116 are respectively located in front of the first terminal grooves 1122 and the second terminal grooves 1123.

Referring to FIG. 3 to FIG. 7 again, the front ends of the bottom wall and the top wall of the two recesses 113 define a plurality of openings 117 respectively located in front of the two protruding ribs 116. Front surfaces of the two protruding ribs 116 respectively define a plurality of locating gaps 1161. Two opposite sides of the base body 11 open two clamping grooves 118 respectively penetrating through rear surfaces of the two opposite sides of the base body 11. Front ends of the two clamping grooves 118 transversely penetrate through middles of two opposite sidewalls of the insertion groove 111, respectively. Rear ends of the two clamping grooves 118 transversely penetrate through middles of two opposite sidewalls of the assembling groove 112, respectively. Front ends of the two clamping grooves 118 are communicated with the insertion chamber 111. Rear ends of the two clamping grooves 118 are communicated with the assembling groove 112. An upper side and a lower side of each side wall of the assembling groove 112 extend inward to form a pair of guide rails 119 for guiding the terminal module 20. Each of the guide rails 119 defines a restricting groove 120.

Referring to FIG. 2 to FIG. 5, the terminal module 20 includes a first terminal module 21, and a second terminal module 22 mounted to the first terminal module 21. The first terminal module 21 has a step-shaped first main body 211, and a plurality of spaced first terminals 212 fixed to the first main body 211. Rear ends of the first terminals 212 project beyond a rear surface of the first main body 211, and front ends of the first terminals 212 project beyond a front surface of the first main body 211. The second terminal module 22 has a step-shaped second main body 221, and a plurality of spaced second terminals 222 fixed to the second main body 221. Rear ends of the second terminals 222 project beyond a rear surface of the second main body 221, and front ends of the second terminals 222 project beyond a front surface of the second main body 221.

Figure 5:
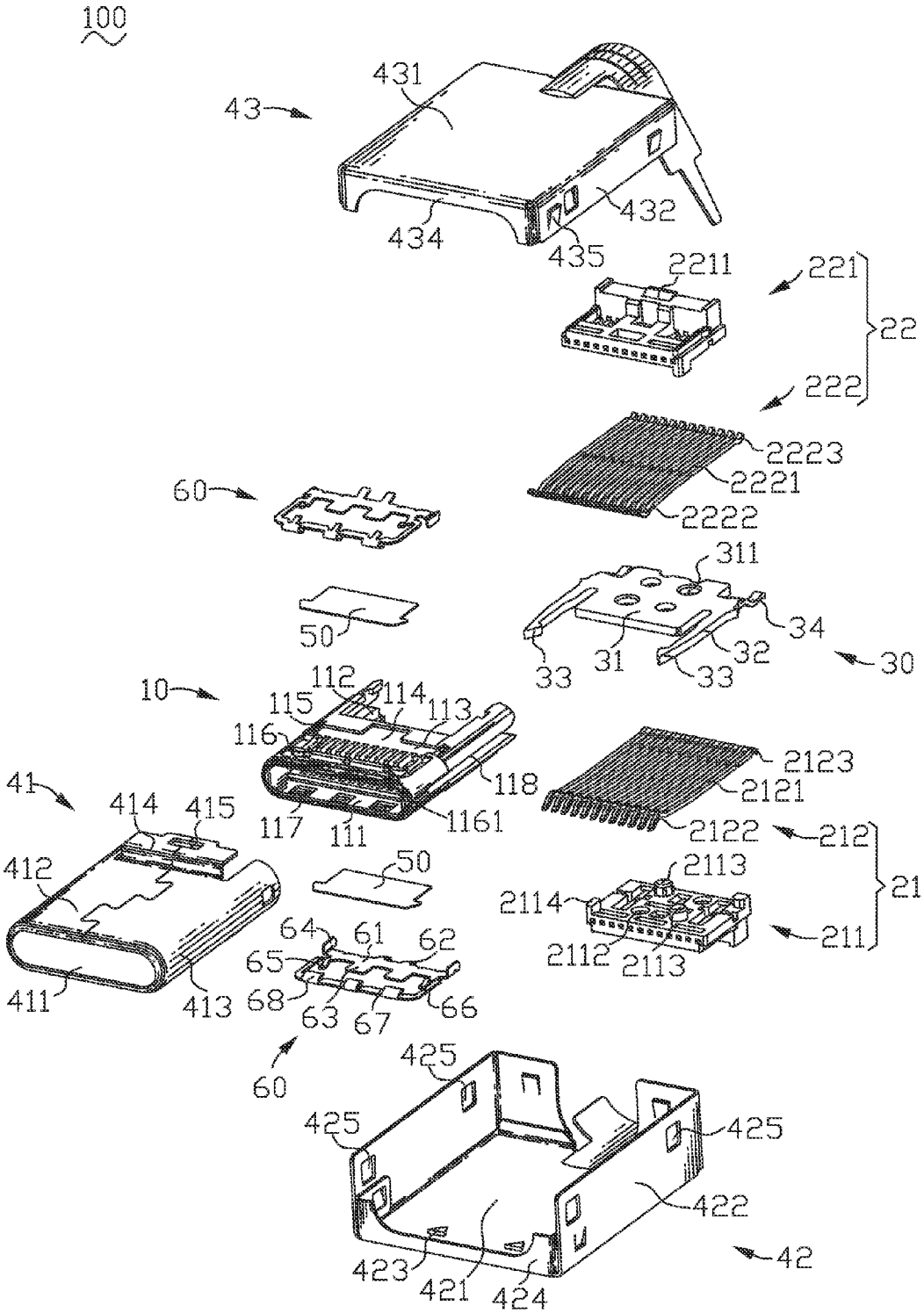
FIG. 5 is another exploded view of the plug connector of FIG. 1.
Figure 6:
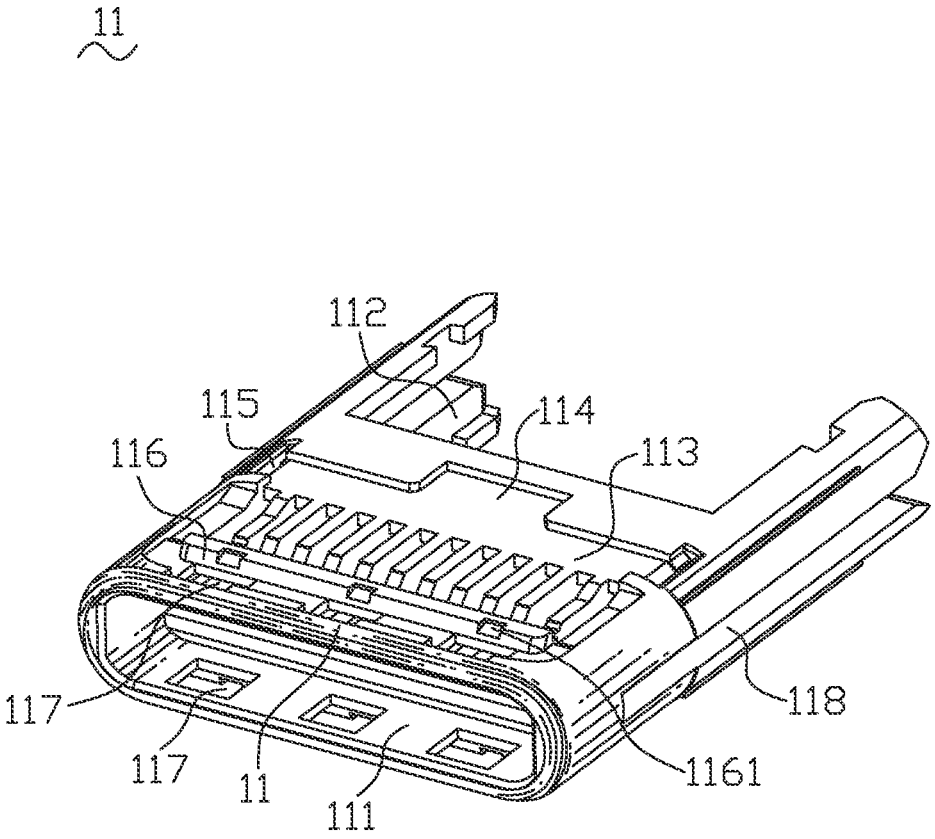
FIG. 6 is a perspective view of an insulating housing of the plug connector of FIG. 5.
Figure 7:
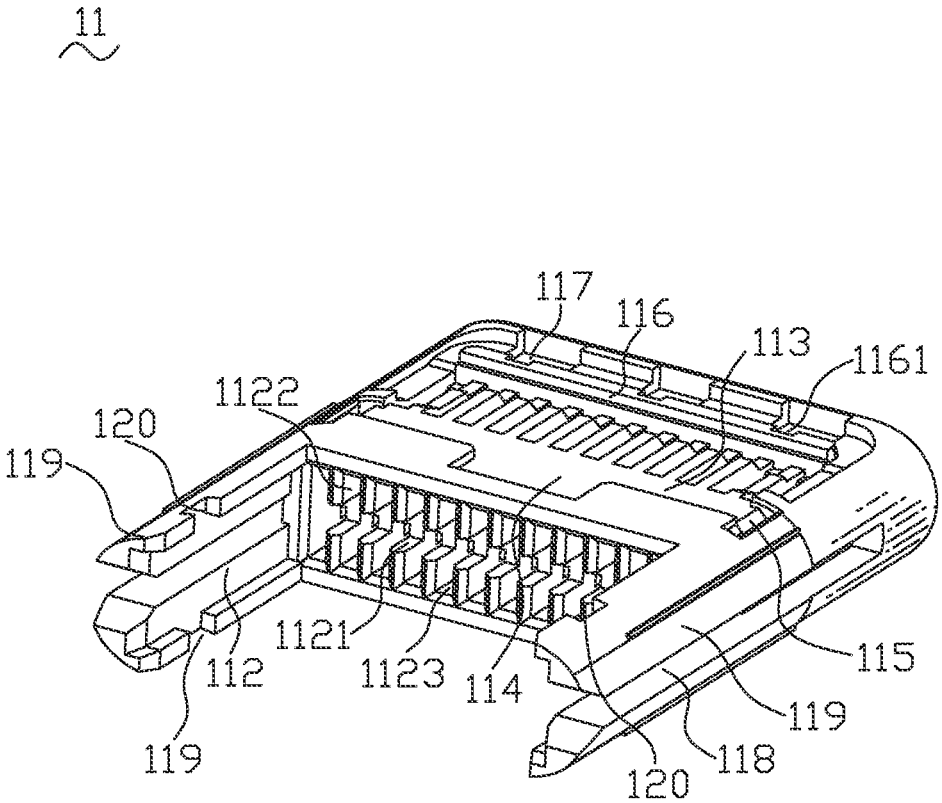
FIG. 7 is another perspective view of the insulating housing of the plug connector of FIG. 5.

Referring to FIG. 4 and FIG. 5, a middle of a rear end of a top surface of the first main body 211 protrudes upward to form a first wedge portion 2111. A bottom surface of the first main body 211 defines two first fastening holes 2112 and two first fastening pillars 2113. Two nonadjacent corners of the bottom surface of the first main body 211 protrude downward to form two first propping portions 2114. Two opposite sides of the first main body 211 protrude outward to form two second wedge portions 2115.

Referring to FIG. 4, each of the first terminals 212 has an elongated first fastening arm 2121 disposed longitudinally. A front end of the first fastening arm 2121 is arched downward to form a first contact arm 2122. A rear end of the first fastening arm 2121 is arched downward to form a first soldering arm 2123. The first terminals 212 are integrally molded to the first main body 211. A substantial middle of the first fastening arm 2121 of each of the first terminals 212 is molded in the first main body 211. The front end of the first fastening arm 2121 and the first contact arm 2122 project beyond a front surface of the first main body 211. The rear end of the first fastening arm 2121 and the first soldering arm 2123 project beyond a rear surface of the first main body 211.

Referring to FIG. 4 and FIG. 5, a middle of a rear end of a bottom surface of the second main body 221 protrudes downward to form a third wedge portion 2211. A top surface of the second main body 221 defines two second fastening holes 2212 corresponding to the two first fastening pillars 2113, and two second fastening pillars 2213 corresponding to the two first fastening holes 2112. Two nonadjacent corners of the top surface of the second main body 221 protrude upward to form two second propping portions 2214. The other two corners of the top surface of the second main body 221 are corresponding to the two first propping portions 2114. Two opposite sides of the second main body 221 protrude outward to form two fourth wedge portions 2215.

Referring to FIG. 4, each of the second terminals 222 has an elongated second fastening arm 2221 disposed longitudinally. A front end of the second fastening arm 2221 is arched upward to form a second contact arm 2222. A rear end of the second fastening arm 2221 is arched upward to form a second soldering arm 2223. The second terminals 222 are integrally molded to the second main body 221. A substantial middle of the second fastening arm 2221 of each of the second terminals 222 is molded in the second main body 221. The front end of the second fastening arm 2221 and the second contact arm 2222 project beyond the front surface of the second main body 221. The rear end of the second fastening arm 2221 and the second soldering arm 2223 project beyond the rear surface of the second main body 221.

Figure 3:
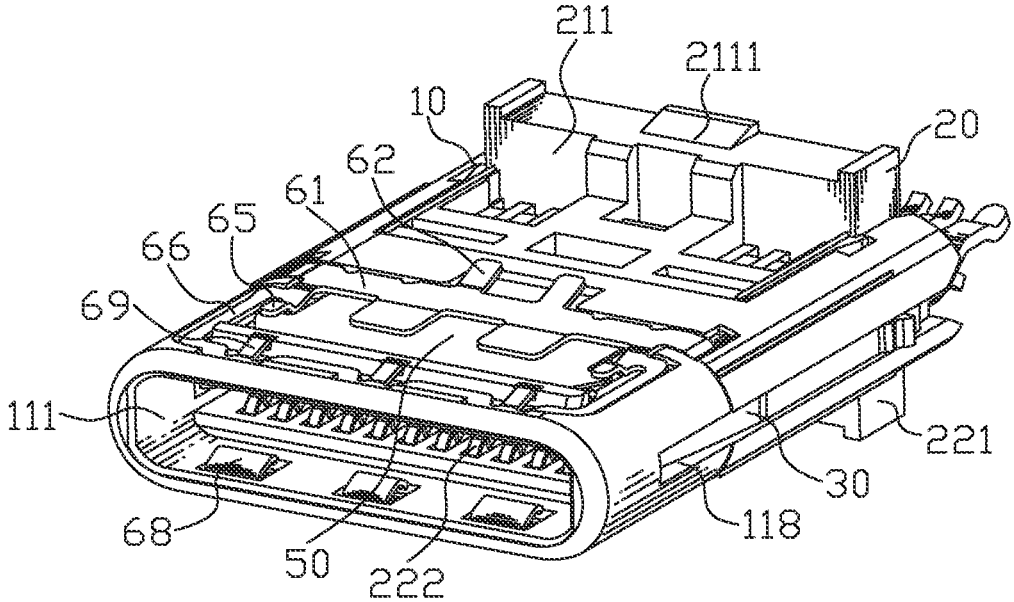
FIG. 3 is a partially perspective view of the plug connector of FIG. 1, wherein a shielding shell is moved away.

Referring to FIG. 3 to FIG. 5, the middle shielding piece 30 is made of a metal plate. The middle shielding piece 30 has a base plate 31 disposed horizontally. Two portions of two opposite sides of the base plate 31 extend outward and then extend frontward to form two lateral arms 32 spaced from the two opposite sides of the base plate 31. Front ends of two facing surfaces of the two lateral arms 32 protrude face to face to form two hooking portions 33. Two inner surfaces of the two hooking portions 33 are planes for improving anti-abrasion performance of the two hooking portions 33. An upper end of a rear surface of each of the lateral arms 32 meanders rearward to form a soldering portion 34. A thickness of the soldering portion 34 of the middle shielding piece 30 is thinner than thicknesses of the base plate 31 and the lateral arms 32 of the middle shielding piece 30. The base plate 31 of the middle shielding piece 30 defines a plurality of perforations 311 corresponding to the first fastening pillars 2113 and the first fastening holes 2112 separately.

Referring to FIG. 1 to FIG. 5, the shielding shell 40 includes a front shell 41, an upper shell 42 and a lower shell 43. The front shell 41 is shown a hollow racetrack shape from a front view. The front shell 41 has a top plate 411, a bottom plate 412, and two arc-shaped connecting plates 413 connected between the top plate 411 and the bottom plate 412. Each of the connecting plates 413 extends beyond rear edges of the top plate 411 and the bottom plate 412. The rear edges of the top plate 411 and the bottom plate 412 protrude oppositely and then are bent rearward to form two fastening plates 414. The two fastening plates 414 define two locating holes 415.

Referring to FIG. 4 and FIG. 5, the upper shell 42 has a rectangular upper plate 421, and two first lateral plates 422 extended downward from two opposite sides of the upper plate 421. Two sides of a bottom surface of the upper plate 421 protrude downward to form two first abutting portions 423. Front ends of the upper plate 421 and the two first lateral plates 422 are connected with an arc-shaped first sealing plate 424. A middle of a bottom of the first sealing plate 424 is opened. Each of the first lateral plates 422 defines a plurality of buckling holes 425.

Referring to FIG. 4 and FIG. 5 again, the lower shell 43 has a rectangular lower plate 431, and two second lateral plates 432 extended upward from two opposite sides of the lower plate 431. Two sides of a top surface of the lower plate 431 protrude upward to form two second abutting portions 433. Front ends of the lower plate 431 and the two second lateral plates 432 are connected with an arc-shaped second sealing plate 434. A middle of a top of the second sealing plate 434 is opened. Several portions of each of the second lateral plates 432 are punched outward to form a plurality of buckling pieces 435.

Referring to FIG. 3 to FIG. 5, each of the ground pieces 60 has a rectangular base slice 61. Two portions of a rear edge of the base slice 61 extend rearward and then slantwise extend outward and rearward to form two elastic abutting slices 62. Two portions of a front edge of the base slice 61 extend frontward to form two limiting slices 63. Two opposite sides of the base slice 61 extend outward and then are bent downward to form two fixing slices 64. Two sides of the front edge of the base slice 61 slantwise extend outward and frontward, and then are arched outward and further extend frontward to form two blocking arms 65.

Referring to FIG. 3 to FIG. 5 again, outer sides of rear ends of the two blocking arms 65 protrude outward and then extend frontward to form two extending arms 66. Free ends of the two extending arms 66 are connected by a connecting arm 67. Several portions of a front edge of the connecting arm 67 are curved inward and rearward to form a plurality of elastic contact portions 68. Several portions of a rear edge of the connecting arm 67 slantwise extend outward and rearward to form a plurality of locating slices 69. Each of the locating slices 69 is corresponding to one of the elastic contact portions 68.

Referring to FIG. 1 to FIG. 7, when the plug connector 100 is assembled, the middle shielding piece 30 is mounted between the first terminal module 21 and the second terminal module 22. The first fastening pillars 2113 and the second fastening pillars 2213 pass through the perforations 311 of the middle shielding piece 30 to be inserted into the second fastening holes 2212 and the first fastening holes 2112. The first propping portions 2114 prop against the top surface of the second main body 221, the second propping portions 2214 prop against the bottom surface of the first main body 211. The terminal module 20 together with the middle shielding piece 30 is assembled to the assembling groove 112 of the insulating housing 10. The first main body 211 and the second main body 221 are assembled in the assembling groove 112. The second wedge portions 2115 and the fourth wedge portions 2215 are restricted in the corresponding restricting grooves 120. The front ends of the first fastening arms 2121 and the first contact arms 2122 of the first terminals 212 pass through the first terminal grooves 1122. The first contact arms 2122 of the first terminals 212 are exposed to the insertion chamber 111. The front ends of the second fastening arms 2221 and the second contact arms 2222 of the second terminals 222 pass through the second terminal grooves 1123. The second contact arms 2222 of the second terminals 222 are exposed to the insertion chamber 111. The first soldering arm 2123 of each of the first terminals 212 and the second soldering arm 2223 of each of the second terminals 222 project out of the assembling groove 112.

A front end of the base plate 31 of the middle shielding piece 30 is fastened to the fastening slot 1121. The two lateral arms 32 of the middle shielding piece 30 are respectively disposed in the two clamping grooves 118. The two hooking portions 33 of the middle shielding piece 30 project into the insertion chamber 111. Each soldering portion 34 of the middle shielding piece 30 projects out of the clamping grooves 118 of the insulating housing 10. The soldering portions 34, the first soldering arms 2123 and the second soldering arms 2223 are soldered on a circuit board (not shown).

The two ground pieces 60 are respectively received in the two recesses 113. The base slices 61 and the limiting slices 63 of the two ground pieces 60 are located in the two recesses 113. The elastic abutting slices 62 of the two ground pieces 60 project into the two indentations 114. The fixing slices 64 of the two ground pieces 60 are fixed in the fixing slots 115. The extending arms 66 and the connecting arms 67 of the two ground pieces 60 are received in the two recesses 113. The elastic contact portions 68 are disposed to the openings 117 and further project into the insertion chamber 111. The locating slices 69 are located in the locating gaps 1161. The elastic abutting slices 62 electrically contact the front shell 41 of the shielding shell 40.

One of the insulation films 50 is disposed between one of the ground pieces 60 and the base body 11, and the other insulation film 50 is disposed between the other ground piece 60 and the base body 11. The limiting slices 63 limit the two insulation films 50 in the two recesses 113. The blocking arms 65 block two outer surfaces of the two insulation films 50 from tilting.

The shielding shell 40 surrounds the insulating housing 10 and the terminal module 20. Specifically, the front shell 41 of the shielding shell 40 surrounds the insulating housing 10 and the terminal module 20. The first wedge portion 2111 and the third wedge portion 2211 are fastened to the locating holes 415. The first abutting portions 423 of the upper shell 42 and the second abutting portions 433 of the lower shell 43 abut against rear edges of the corresponding fastening plates 414 of the front shell 41.

The upper shell 42 and the lower shell 43 are respectively mounted to a rear end of the front shell 41. The lower shell 43 and the upper shell 42 are matched with each other and surround the rear end of the front shell 41. The first sealing plate 424 and the second sealing plate 434 are matched with each other and are disposed on the rear end of the front shell 41. The first sealing plate 424 and the second sealing plate 434 respectively abut against front surfaces of the corresponding fastening plates 414 of the front shell 41. The buckling pieces 435 are buckled in the buckling holes 425. So that the rear end of the front shell 41 is fastened between the upper shell 42 and the lower shell 43 for ensuring a contact stability among the front shell 41, the upper shell 42 and the lower shell 43.

As described above, the thickness of the soldering portion 34 of the middle shielding piece 30 is thinner than the thicknesses of the base plate 31 and the lateral arms 32 of the middle shielding piece 30 for improving an elasticity of the soldering portion 34, so the soldering portion 34 is easily soldered on the circuit board. As a result, signals transmitted by the plug connector 100 are stable.

What is claimed is:

1. A plug connector, comprising:

an insulating housing having a base body, a front end of the base body defining an insertion chamber penetrating through a middle of a front surface of the base body, a rear end of the base body defining an assembling groove vertically penetrating through a middle of the rear end of the base body and further penetrating through a rear surface of the base body, a middle of a front wall of the assembling groove being recessed frontward to form a fastening slot extending in a transverse direction;

a terminal module including a first terminal module, and a second terminal module mounted to the first terminal module, the first terminal module having a first main body assembled in the assembling groove, and a plurality of spaced first terminals fixed to the first main body, rear ends of the first terminals projecting beyond a rear surface of the first main body, and front ends of the first terminals projecting beyond a front surface of the first main body, the second terminal module having a second main body assembled in the assembling groove, and a plurality of spaced second terminals fixed to the second main body, rear ends of the second terminals projecting beyond a rear surface of the second main body, and front ends of the second terminals projecting beyond a front surface of the second main body;

a middle shielding piece mounted between the first terminal module and the second terminal module, the terminal module together with the middle shielding piece being assembled to the assembling groove of the insulating housing, the middle shielding piece having a base plate, a front end of the base plate of the middle shielding piece being fastened to the fastening slot, two portions of two opposite sides of the base plate extending outward and then extending frontward to form two lateral arms spaced from the two opposite sides of the base plate, an upper end of a rear surface of each of the lateral arms meandering rearward to form a soldering portion projecting out of the insulating housing, a thickness of the soldering portion being thinner than thicknesses of the base plate and the lateral arms; and a shielding shell surrounding the insulating housing and the terminal module.

2. The plug connector as claimed in claim 1, wherein the shielding shell includes a front shell, an upper shell and a lower shell, the front shell surrounds the insulating housing and the terminal module, the upper shell and the lower shell are respectively mounted to a rear end of the front shell, the lower shell and the upper shell are matched with each other and surround the rear end of the front shell.

3. The plug connector as claimed in claim 2, wherein the front shell has a top plate, and a bottom plate, rear edges of the top plate and the bottom plate protrude oppositely and then are bent rearward to form two fastening plates, the two fastening plates define two locating holes, a top surface of the first main body protrudes upward to form a first wedge portion, a bottom surface of the second main body protrudes downward to form a third wedge portion, the first wedge portion and the third wedge portion are fastened to the locating holes.

4. The plug connector as claimed in claim 3, wherein the upper shell has an upper plate, and two first lateral plates extended downward from two opposite sides of the upper plate, front ends of the upper plate and the two first lateral plates are connected with an arc-shaped first sealing plate, the lower shell has a lower plate, and two second lateral plates extended upward from two opposite sides of the lower plate, front ends of the lower plate and the two second lateral plates are connected with an arc-shaped second sealing plate, the first sealing plate and the second sealing plate are matched with each other and are disposed on the rear end of the front shell, the first sealing plate and the second sealing plate respectively abut against front surfaces of the corresponding fastening plates of the front shell.

5. The plug connector as claimed in claim 4, wherein two sides of a bottom surface of the upper plate protrude downward to form two first abutting portions, two sides of a top surface of the lower plate protrude upward to form two second abutting portions, the first abutting portions and the second abutting portions abut against rear edges of the corresponding fastening plates of the front shell.

6. The plug connector as claimed in claim 4, wherein each of the first lateral plates defines a plurality of buckling holes, several portions of each of the second lateral plates are punched outward to form a plurality of buckling pieces, the buckling pieces are buckled in the buckling holes.

7. The plug connector as claimed in claim 1, wherein the base body defines a plurality of first terminal grooves and a plurality of second terminal grooves, a front end of each of the first terminal grooves penetrates through a top wall of the insertion chamber, a front end of each of the second terminal grooves penetrates through a bottom wall of the insertion chamber, rear ends of the first terminal grooves and the second terminal grooves are communicated with the assembling groove, the fastening slot is located between first terminal grooves and the second terminal grooves.

8. The plug connector as claimed in claim 1, further comprising two insulation films and two ground pieces, substantially middles of a top surface and a bottom surface of the base body being recessed inward to form two recesses, the two ground pieces being respectively received in the two recesses, each of the ground pieces having a base slice, two portions of a front edge of the base slice extending frontward to form two limiting slices, two sides of a front edge of the base slice slantwise extending outward and frontward, and then being arched outward and further extending frontward to form two blocking arms, one of the insulation films being disposed between one of the ground pieces and the base body, and the other insulation film being disposed between the other ground piece and the base body, the limiting slices limiting the two insulation films in the two recesses, the blocking arms blocking two outer surfaces of the two insulation films from tilting.

9. The plug connector as claimed in claim 8, wherein the two recesses are respectively communicated with the first terminal grooves and the second terminal grooves, middles of rear walls of the two recesses are recessed rearward to form two indentations, rear ends of two sides of a bottom wall and two sides of a top wall of the two recesses are recessed inward to form a plurality of fixing slots, two portions of a rear edge of the base slice extend rearward and then slantwise extend outward and rearward to form two elastic abutting slices, two opposite sides of the base slice extend outward and then are bent downward to form two fixing slices, the elastic abutting slices project into the two indentations, the fixing slices are fixed in the fixing slots, the elastic abutting slices electrically contact the shielding shell.

10. The plug connector as claimed in claim 9, wherein front ends of the bottom wall and the top wall of the two recesses protrude outward to form two protruding ribs, the front ends of the bottom wall and the top wall of the two recesses define a plurality of openings respectively located in front of the two protruding ribs, outer sides of rear ends of the two blocking arms protrude outward and then extend frontward to form two extending arms, free ends of the two extending arms are connected by a connecting arm, several portions of a front edge of the connecting arm are curved inward and rearward to form a plurality of elastic contact portions, the extending arms and the connecting arms are received in the two recesses, the elastic contact portions are disposed to the openings and further project into the insertion chamber.

11. The plug connector as claimed in claim 10, wherein front surfaces of the two protruding ribs respectively define a plurality of locating gaps, several portions of a rear edge of the connecting arm slantwise extend outward and rearward to form a plurality of locating slices, the locating slices are located in the locating gaps.

12. The plug connector as claimed in claim 1, wherein two opposite sides of the base body open two clamping grooves respectively penetrating through rear surfaces of the two opposite sides of the base body, front ends of the two clamping grooves are communicated with the insertion chamber, respectively, front ends of two facing surfaces of the two lateral arms of the middle shielding piece protrude face to face to form two hooking portions, the two lateral arms of the middle shielding piece are respectively disposed in the two clamping grooves, the two hooking portions project into the insertion chamber.

13. The plug connector as claimed in claim 12, wherein an upper side and a lower side of each side wall of the assembling groove extend inward to form a pair of guide rails for guiding the terminal module, each of the guide rails defines a restricting groove, two opposite sides of the first main body protrude outward to form two second wedge portions, two opposite sides of the second main body protrude outward to form two fourth wedge portions, the second wedge portions and the fourth wedge portions are restricted in the corresponding restricting grooves.

14. The plug connector as claimed in claim 1, wherein a bottom surface of the first main body defines two first fastening holes and two first fastening pillars, two nonadjacent corners of the bottom surface of the first main body protrude downward to form two first propping portions, a top surface of the second main body defines two second fastening holes corresponding to the two first fastening pillars, and two second fastening pillars corresponding to the two first fastening holes, two nonadjacent corners of the top surface of the second main body protrude upward to form two second propping portions, the base plate of the middle shielding piece defines a plurality of perforations corresponding to the first fastening pillars and the first fastening holes separately, the first fastening pillars and the second fastening pillars pass through the perforations to be inserted into the second fastening holes and the first fastening holes, the first propping portions prop against the top surface of the second main body, the second propping portions prop against the bottom surface of the first main body.

* * * * *